United States Patent [19]

Johnson et al.

[11] 4,001,961

[45] Jan. 11, 1977

[54] ROUND COUNTER

[75] Inventors: Curtis D. Johnson; Hal E. Weidner, both of Davenport, Iowa

[73] Assignee: The United States of America as represented by the Secretary of the Army, Washington, D.C.

[22] Filed: Sept. 3, 1975

[21] Appl. No.: 610,028

[52] U.S. Cl. ..... 42/1 E; 324/94; 346/38

[51] Int. Cl.[2] ..... F41C 27/00

[58] Field of Search ..... 42/1 E, 1 A; 89/9; 324/94; 340/173 CH; 346/38

[56] References Cited

UNITED STATES PATENTS

| | | | |
|---|---|---|---|
| 1,273,078 | 7/1918 | McManus | 89/9 |
| 2,354,079 | 7/1944 | Webb | 42/1 E |
| 3,045,178 | 7/1962 | Corrsin | 324/94 |
| 3,090,914 | 5/1963 | Kabak | 324/94 |

*Primary Examiner*—Stephen C. Bentley
*Attorney, Agent, or Firm*—Nathan Edelberg; Harold H. Card, Jr.; Robert O. Richardson

[57] ABSTRACT

An electrochemical elapsed time meter indicator with round counter circuitry for a gun to indicate past usage whereby maintenance and repair or replacement procedures will insure greater reliability in critical field use. The meter, working on an electroplating principle as a function of current and time, may be activated by gun use such as by a switch on the gun trigger, an inductance or piezoelectric transducer in the buffer, a recoil operated microswitch or as part of the circuit in externally powered guns. The meter preferably is color coded to indicate weapon condition, area of use, and replacement or maintenance required.

5 Claims, 7 Drawing Figures

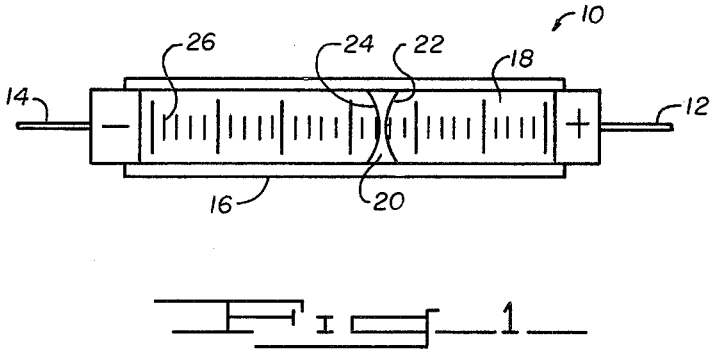
10
26
24
22
18
14
12
16
20
1
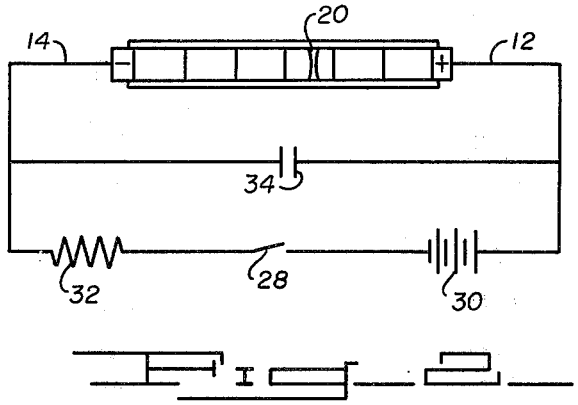
20
14
12
34
32
28
30
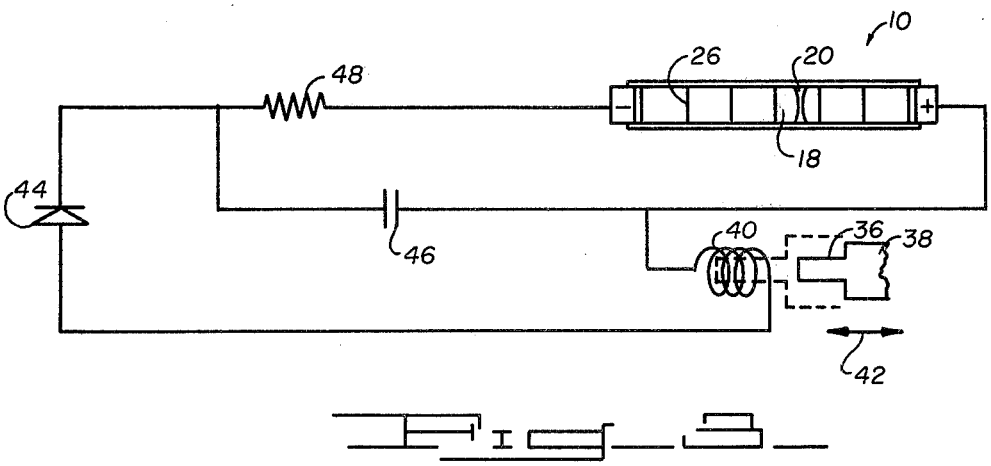
10
48
26
20
18
44
46
40
36
38
42

ROUND COUNTER

BACKGROUND OF THE PRESENT INVENTION

In the development of weapon systems, strength, weight and size are prime considerations. As materials and production techniques have improved, proportionate reductions in weapon weight and size are achieved at the expense of no significant increase in component strength. A certain degree of weapon stoppages have been endured due to parts breakage, often at very critical times, resulting in losses of life and combat effectiveness.

Continued use of a weapon has a degrading effect upon the reliability, availability, and maintainability of its mechanical system. Weapon part life, in general, is not time related but use related. Reliability can be significantly improved when certain components are replaced on a planned schedule prior to predicted failure or wearout. Significant data ordinarily exists as a result of extensive development testing concerning the wearout characteristics of a component and its expected life. Additional data may be attained when required through variability analysis and probabilistic design techniques. For planned replacement of parts to be effective, however, there must be a means to measure the wear or condition of the weapon system.

SUMMARY OF THE PRESENT INVENTION

An effective indication of the prior use of a weapon is the number of rounds of ammunition fired by that weapon. This information may then be used to determine if certain components have reached their useful life expectation and should be replaced before further use is made of the weapon in a critical use area, such as in a combat zone for example.

In accordance with the present invention a round counter and associated circuitry is attached to a weapon for indicating the extent of its use. Such an indicator preferably is an elapsed time meter such as one marketed as a "Curtis Indachron" by Curtis Instruments, Inc., Mount Kisco, N.Y. This meter is composed of a capillary tube, a cathode, an anode and a mercury column interrupted by an electrolytic gap. As current passes through a circuit in which the elapsed time meter is a component, mercury atoms are ionized and move to the left through the electrolytic medium by induction of the electrical field imposed. When the ionized atoms reach the left-most boundary of the electrolytic gap, their charge is given up and they electrodeposit themselves on that boundary. Continuous or interrupted current and flow of atoms to the left causes migration of the electrolytic gap to the right, resulting in a linear measure of elapsed current-time, a function which is not necessarily voltage related.

With appropriate circuitry the meter indicator may be activated when the weapon is in use. This may be done by closing a switch with a trigger pull, by an inductance or piezoelectric transducer in the buffer, by closing a recoil operated microswitch, or the indicator meter may be placed in the circuit used in externally powered guns.

Preferably the meter indicator scale is also color coded to indicate renewal maintenance requirements or area of use. For example, "green" level weapons may be used in a combat or overseas theater whereas "red" level or badly worn weapons would be used only in the reserve and basic training units where frequent maintenance and malfunctions are desired and beneficial for training. A more sophisticated color coding system may involve a number of life zones and, as each new zone is entered, a color coded package of replacement parts and maintenance equipment with instructions may be provided the operator. For example a black zone may mean 15,000 rounds have been fired and a new extractor should be installed. Proper implementation ensures a ready condition of all weapon systems and avoids weapon component failures at critical times averting loss of operational effectiveness.

The round counter of the present invention is relatively accurate, rugged, simple, inexpensive, reliable, and capable of mounting on various weapon locations. While compact enough for use on small arms, its application may be exploited in many other fields where cycling mechanical devices are employed.

BRIEF DESCRIPTION OF THE DRAWINGS

FIG. 1 is a plan view of the indicator meter,

FIG. 2 is a diagram of a basic meter circuit,

FIG. 3 is a circuit diagram of an induction transducer counter,

DETAILED DESCRIPTON OF ILLUSTRATIVE EMBODIMENT

Figure 4:
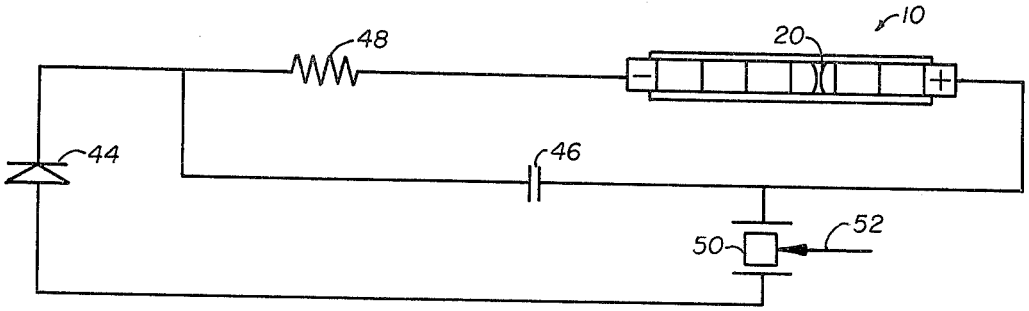
FIG. 4 is a circuit diagram of a piezo-electric counter.

Reference is now made to FIG. 1 wherein there is shown an electrochemical meter 10 of the type marketed by Curtis Instruments, Inc., Mount Kisco, N.Y., and known as a "Curtis Indachron". It is composed of an anode 12, a cathode 14, a capillary tube 16, and a mercury column 18 interrupted by an electrolytic gap 20. The application of a current flow through the meter causes mercury to be plated from the anode surface 22 to the cathode surface 24. Continued current flow will cause the gap 20 to migrate from the starting end at the cathode 14 of the meter to the anode end 12. The distance that the gap moves is proportional to the product of current and time. A plastic scale 26 indicating round accumulation is superimposed on the meter face. By inducing current to flow each time a weapon is fired or during the duration of an automatic burst, such a meter may be used, with proper calibration, to indicate the total number of rounds fired by the location of the gap 20 along the scale 26.

In FIG. 2 is shown a basic circuit using the weapon's firing mechanism as a switch 28. A miniaturized battery 30 provides current and a scaling resistor 32 is adjusted for the desired full scale reading. Capacitor 34 is connected in parallel with meter 10 to integrate the impulse and normalize it so that all shots have the same capability of registering.

FIG. 3 is a circuit diagram for an induction transducer counter which generates pulses of current of short duration corresponding to each shot as the weapon is fired. Current passes through the meter 10 and the total rounds fired corresponds to the reading on scale 26 opposite gap 20. This circuit is activated by a magnetic rod 36 attached to some reciprocating part 38 of the weapon, such as a bolt carrier for example. This magnetic rod moves into and out of induction coil 40 as shown by the double pointed arrow 42. The induced current is rectified by diode 44 to insure proper polarity of the pulses which are then stored on capacitor 46. This capacitor discharges through a calibrating resistor 48 and meter 10 which records the fired round as previously explained. It should be noted that this circuit requires no external power source.

FIG. 4 is a circuit diagram similar to that shown in FIG. 3 except that another type of transducer is utilized to provide an electrical impetus. Here a piezo-electric force transducer 50 is used to generate a voltage pulse when force is applied to it as a result of a round discharge. This force, shown by arrow 52, may be from a buffer impact, feed cam or other component displacement. The energy generated by the transducer 50 is stored on capacitor 46 and allowed to discharge through meter 10, thereby registering the firing of the round. Similarly, any medium through which mechanical energy may be converted to electrical energy may be substituted for transducer 50.

Figure 5:
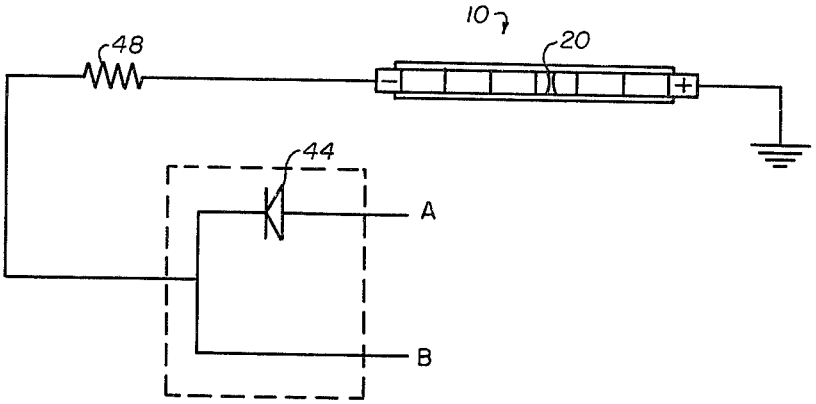
FIG. 5 is a circuit diagram for a counter for a electrically powered weapon.

Some weapons are externally powered. When such power is electrical, the same power source used to operate the gun motor may be used to operate the counter. Where the cyclic rate of the weapon is a linear function of current and/or voltage applied, the circuitry shown in FIG. 5 may be used in the weapon's electrical system. Where direct current is used as a power source only a scaling resistor 48 and meter 10 are utilized, and the input is applied at terminal B. If an alternating current is used a rectifying diode 44 is added by applying the input to terminal A.

Figure 6:
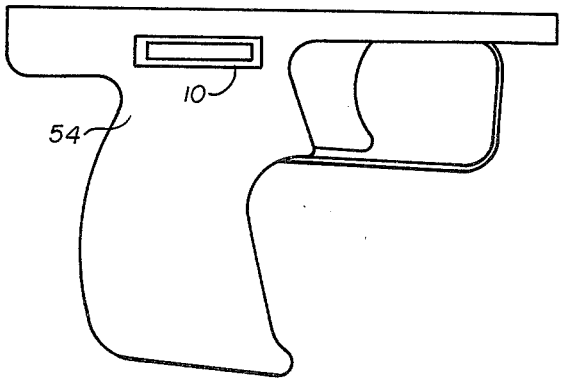
FIG. 6 is an elevational view of a counter mounted on a trigger assembly.
Figure 7:
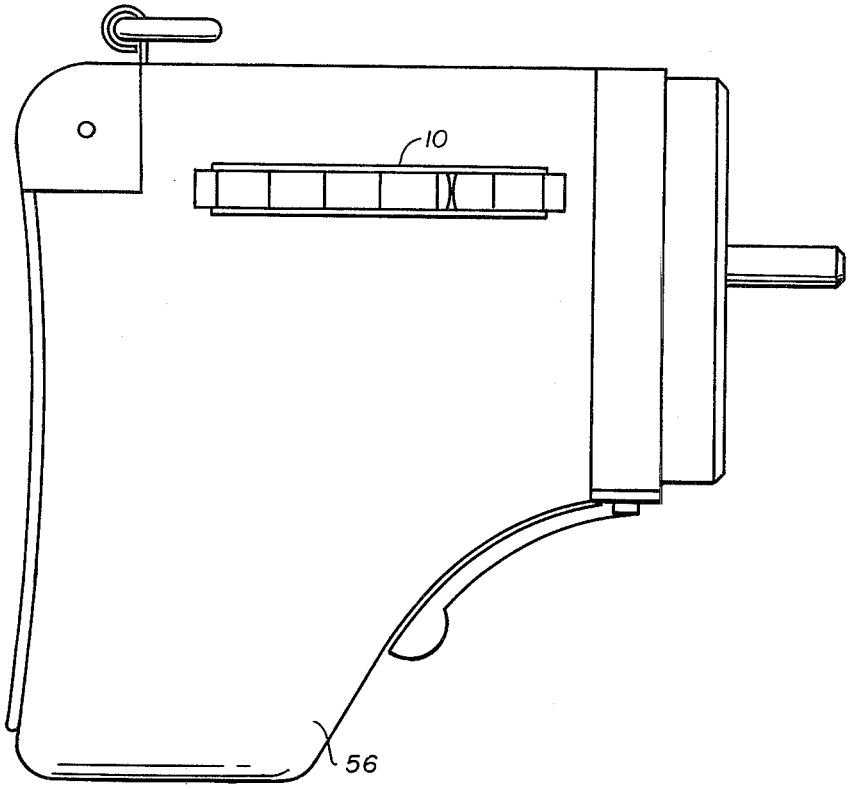
FIG. 7 is an elevational view of a counter mounted in a buttstock assembly.

Relative size of presently available components will allow fabrication of counters whose size is negligible compared to that of the weapon with which it is used. For example, FIG. 6 shows meter 10 embedded in a trigger grip assembly 54. FIG. 7 shows meter 10 embedded in the buttstock assembly 56 of a machine gun. The meter, transducer and circuitry may be applied anywhere on the weapon using a number of mechanical means of application.

The round counter system of the present invention may be calibrated to accommodate any range of weapon life the calibration being dependent only upon proper choice of subordinate electrical components. The round counter scale may be very finely graduated to improve accuracy and a magnifying window may be added to make such readings possible. In addition, the scale may be color-coded to satisfy renewal maintenance requirements or the area of use as earlier mentioned.

In general, it is felt that the principles and concepts herein described when coupled with the newly founded theories of renewal and preventative maintenance or component replacement can greatly increase the combat effectiveness of our soldiers and more importantly, save lives; by eliminating a major portion of weapon stoppages in combat situations. However, the present invention is not limited to the small arms field but may be applied in many unrelated areas where it is deemed important to record accurately the number of cycles of a mechanical or electrical mechanism.

Having described illustrative embodiments of the present invention, alternate forms will occur to those skilled in the art and it is to be understood that these variations are to be considered as part of the present invention as set forth in the following claims.

We claim:

1. A weapon having parts capable of mechanical movement in the firing of said weapon, a weapon buffer, a transducer on said weapon buffer, and an electrochemical elapsed time meter indicator with counter circuitry for indicating the number of cycles a mechanical movement and hence the firing of said weapon to which said indicator and said circuitry are attached, and transducer means on said weapon buffer for actuating said indicator.

2. The structure as set forth in claim 1 wherein said transducer is an inductance transducer.

3. The structure as set forth in claim 1 wherein said transducer is a piezoelectric transducer.

4. An electrochemical elapsed time meter indicator as set forth in claim 1 wherein said circuitry includes a power source, a unidirectional electrical energy filter, a meter scaling resister, a charging capacitor and a transducer actuated in response to said mechanical movement, said filter being connected in series with said power source, said transducer, said indicator and said resister, said charging capacitor being in parallel with said resister and said indicator.

5. An electrochemical elapsed time meter indicator as set forth in claim 1 wherein said circuitry includes an energy source producing energy pulses in response to said mechanical movement, said energy source being connected in series with a scaling resister and said meter, and a charging capacitor being in parallel with said resister and said indicator.

* * * * *